United States Patent [19]

Van Mullekom

[11] 4,326,565

[45] Apr. 27, 1982

[54] APPARATUS FOR INSERTING SUCCESSIVE WEFT YARN LENGTHS IN A SHUTTLELESS WEAVING MACHINE

[76] Inventor: Hubert P. Van Mullekom, Voortseweg 11, Deurne, Netherlands

[21] Appl. No.: 134,649

[22] Filed: Mar. 27, 1980

[30] Foreign Application Priority Data

Apr. 25, 1979 [NL] Netherlands ..... 7903273

[51] Int. Cl.[3] ..... D03D 47/30

[52] U.S. Cl. ..... 139/435

[58] Field of Search ..... 139/435, 453; 226/97

[56] References Cited

U.S. PATENT DOCUMENTS 3,825,038 7/1974 Ormerod ..... 139/453

4,081,000 3/1978 Wollenmann ..... 139/435

4,178,971 12/1979 Malasek et al. ..... 139/435

FOREIGN PATENT DOCUMENTS 1535454 8/1969 Fed. Rep. of Germany ..... 139/435

*Primary Examiner*—Henry Jaudon

*Attorney, Agent, or Firm*—C. O. Marshall, Jr.

[57] ABSTRACT

Apparatus for inserting successive weft yarn lengths originating from different yarn supplies, e.g. different colors, in a shuttleless weaving machine, wherein two blowing nozzles are mounted pivotably together as an assembly around a fixed point, e.g. on the reed baulk. Thereby the nozzles can be quickly brought into operative position which is important with present high speed weaving machines.

5 Claims, 2 Drawing Figures

APPARATUS FOR INSERTING SUCCESSIVE WEFT YARN LENGTHS IN A SHUTTLELESS WEAVING MACHINE

BACKGROUND OF THE INVENTION

The invention relates to an apparatus for inserting successive weft yarn lengths in a shuttleless weaving machine, comprising two or more blowing nozzles arranged to one side of the weaving machine opposite to the end of the weaving shed, which nozzles each cooperate with a weft yarn supply and have been movably arranged such that they may successively be positioned in an operative inserting position with respect to the weaving shed.

Applying more than one weft blowing nozzles which alternatively insert weft yarn lengths, originating from different weft yarn supplies, into the weaving shed is known. The aim thereof is either inserting weft yarns of different nature (e.g. colour) according to a predetermined pattern, or preventing that small differences between supplies of the same weft yarn type become visible in the cloth. In the last case the weft yarn supplies are as it were "mixed" thereby.

In the apparatus as used up till now for this purpose the separate blowing nozzles have been mounted such that they have to be moved into and out of their operative inserting position by translation movements. Particularly with the continuously increasing numbers of revolutions of modern pneumatic weaving machines such translation movements constitute a great disadvantage since relatively large masses have to be accelerated and retarded in very short periods during the successive weaving cycles.

This is true particularly in relation to a weft inserting apparatus which is to be mounted on the reed baulk and therefore, moreover, participates in the reed movements.

SUMMARY OF THE INVENTION

This disadvantage is removed according to the invention in that the blowing nozzles are mounted together pivotable around a fixed point, with the outlet apertures closely adjacent to each other.

In this mounting method of the individual blowing nozzles quick displacements of these nozzles between the inoperative and the operative insert positions thereof may be achieved without difficulties.

Pivoting the assembly of blowing nozzles further may be done with the aid of a simple control mechanism. Thereby it is also possible to mount the assembly of the blowing nozzles on the quickly reciprocating reed baulk while this does not result in a complicated technical construction for the control of the blowing nozzles, as would be the case with a translation movement of the blowing nozzles.

Preferably a known type of blowing nozzle is utilized, comprising a body provided with inlet apertures for the thread and for the transport fluid respectively and a mixing tube, joined thereto, guiding the thread and the transport fluid enclosing this thread.

According to a further feature of the invention the pivot point is situated between the bodies of the blowing nozzles, while the control element for the pivotal movement engages with the joined mixing tubes, namely in a position situated between the nozzle bodies and the outflow ends of the mixing tubes.

In a particular embodiment, in which more than two blowing nozzles are united into a single block, the blowing nozzle block is mounted pivotably around two mutually perpendicular axes. The blowing nozzle block is thereby universally movable around the pivot point.

It is to be noted that from the published Dutch patent application No. 7100266 (=U.S. Pat. No. 3,853,151=British Pat. No. 1,382,612) a colour variation mechanism for a pneumatic weaving machine is known, in which a guide block with four channels, each cooperating with a weft yarn supply, is mounted pivotably around an axis relative to a weft blowing nozzle, such that the guide channels may be moved selectively into an operative position relative to the inlet end of the weft blowing nozzle.

DESCRIPTION OF THE PREFERRED EMBODIMENTS

Figure 1:
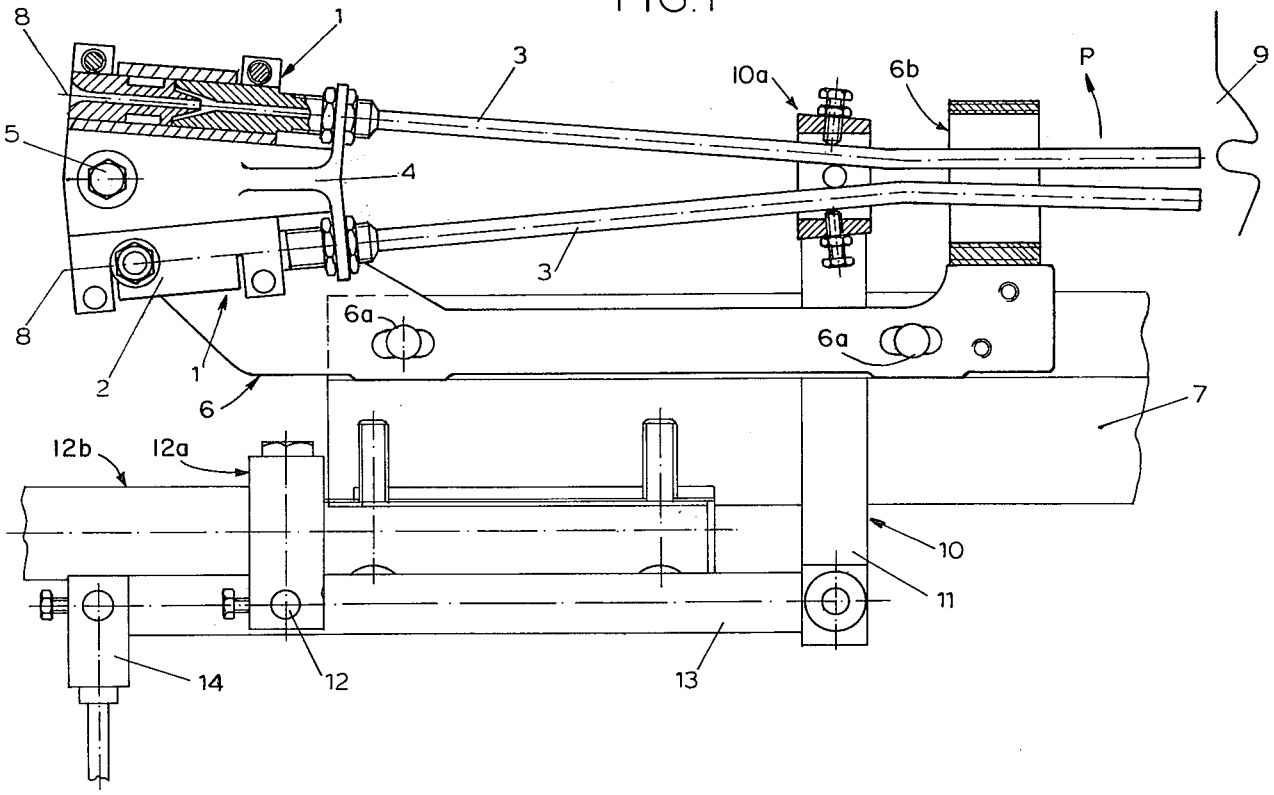
FIG. 1 is an elevation of part of a reed baulk having pivotably mounted thereon an assembly of two blowing nozzles.

In the embodiment according to FIG. 1 two blowing nozzles 1 are used, which are of a type known per se, comprising a nozzle body 2 and an elongated mixing tube 3 joined thereto. Said blowing nozzles are connected to a swing piece 4, which is pivotably mounted around an axis 5 on an auxiliary member 6. Through this auxiliary member 6 the assembly of blowing nozzles is secured on the reed bulk 7 by means of screws 6*a*. A guard 6*b* carried by the member 6 surrounds but is spaced from the mixing tubes 3.

As shown in the drawing the nozzle bodies 2, as seen from the free end of the mixing tube 3, have a somewhat diverging position with respect to each other. Said position facilitates supplying at 8 the weft yarn from the separate weft yarn supplies cooperating with each of the blowing nozzles, said supplies being not further shown.

In FIG. 1 the nozzle assembly is in a position in which the mixing tube 3 of the upper blowing nozzle 1 is in the operative position relative to the weft transport channel formed by the assembly of the contoured reed-lamellae 9. (Therein the reed 9 is shown in a plane which is rotated through 90° with respect to the remainder of the structure).

The nozzle assembly may be pivoted from the position as shown in FIG. 1 around the axis 5 in the direction of the arrow p to a position in which the mixing tube 3 of the lower blowing nozzle arrives in its operative position with respect to the reed 9. The end pieces of the mixing tubes 3 diverge somewhat, as seen in the insert direction, so that the outflow ends of both mixing tubes have in their operative position identical positions with respect to the reed.

For carrying out the pivotal movement around the axis 5 an actuating element 10 is used. This actuating element comprises a block 10*a* enclosing both mixing tubes 3 at a position between the nozzle bodies 2 and the outflow ends of the mixing tubes, which block is pivotably connected through a strap 11 extending, as shown in the drawing, through a space provided between the member 6 and the laterally projecting end of the reed baulk 7, to a lever 13 which is pivotable around a shaft 12 and in turn is pivotably connected to a control rod 14. The shaft 12 is mounted in a bracket 12*a* secured to an arm 12*b* fixed to the bottom of the reed baulk 7. The reed 9, which is mounted in the conventional manner on top of the reed baulk 7, is indicated diagrammatically in FIG. 1 and is shown in detail in FIG. 2. A conventional reed baulk structure, pivoted at the bottom to allow the reed to be reciprocated, is shown in U.S. Pat. No. 4,212,330. The control rod 14 may be actuated in a suitable manner e.g. through a control block.

Figure 2:
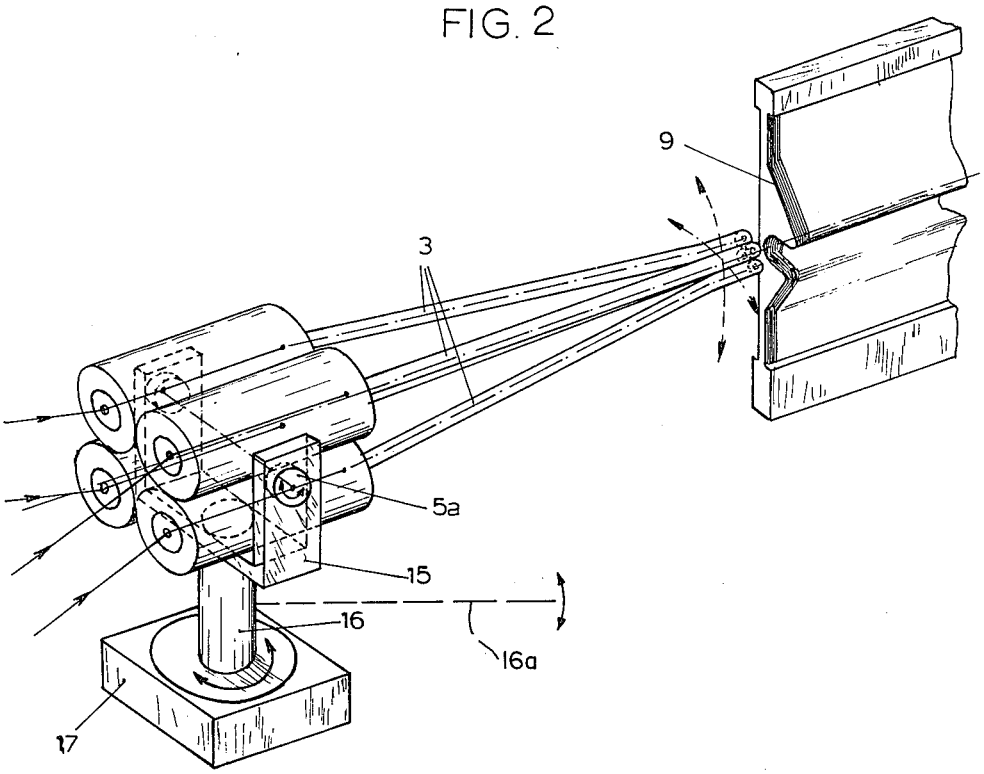
FIG. 2 shows schematically a perspective view of a block comprising four blowing nozzles, which block is pivotably mounted around two mutually perpendicular axes.

FIG. 2 shows that the number of blowing nozzles may be extended to more than two without this leading to increasing the distance through which the nozzle assembly has to be pivoted in order to permit placing each of the blowing nozzles in an operative position with respect to the reed 9. In the embodiment of FIG. 2 four blowing nozzles 1 are united to form a block, each blowing nozzle being fed by a corresponding weft yarn supply, not further shown in the drawing. The nozzle block is pivotably mounted around a shaft 5*a* corresponding to the pivot shaft 5 in the embodiment according to FIG. 1. The pivot shaft 5*a* is journalled in a strap 15 which in turn is mounted on a shaft 16 extending perpendicular to the pivot shaft 5*a* and journalled in the support member 17 which e.g. is part of or is mounted on the reed baulk. In this manner the nozzle block is universally pivotable around the point of intersection of both axes 5*a* and 16. For carrying out the pivotal movement there are different possibilities. For carrying out the pivotal movement around the shaft 5*a* a similar actuation mechanism as shown in FIG. 1, including a block 10*a*, a strap 11, a lever 13 and a control rod 14, could be used, while a pivotal movement around the shaft 16 could be realized through a lever 16*a* fixed to the shaft 16, which could be controlled through a second control cam.

What is claimed is:

1. Apparatus for inserting successive weft yarn lengths in a shuttleless weaving machine, which comprises at least two blowing nozzles each comprising a body having inlet apertures for the yarn and for a transport fluid, and each having a mixing tube joined therewith for guiding the yarn and transport fluid enclosing the yarn, arranged at one side of said weaving machine opposite to one end of a weaving shed, characterized in that the blowing nozzles are jointly mounted to pivot around a fixed point located between the bodies of the blowing nozzles, the outlet ends of the mixing tubes being closely adjacent and being arranged to be brought alternatively into operative inserting position relative to said shed by such pivoting of the blowing nozzles, and an element for controlling such pivoting, which engages the mixing tubes at a point between the nozzle bodies and the outlet ends of the mixing tubes.

2. Apparatus according to claim 1 wherein the fixed point of pivoting of the blowing nozzles is fixed relative to a movable reed baulk of the weaving machine.

3. Apparatus according to claims 1 or 2, in which more than two blowing nozzles are united into a single block, characterized in that the blowing nozzle block is pivotably mounted around two mutually perpendicular axes.

4. Apparatus according to claims 1 or 2, characterized in that the bodies of the blowing nozzles, as seen from the outflow ends of the mixing tubes, have mutually diverging positions.

5. Apparatus according to claims 1 or 2, characterized in that the ends of the mixing tubes, as seen in the insert direction, mutually slightly diverge.

* * * * *